US009085182B2

(12) United States Patent
Hisaoka et al.

(10) Patent No.: US 9,085,182 B2
(45) Date of Patent: Jul. 21, 2015

(54) DATA PROCESSING METHOD OF PRINTING APPARATUS AND THE PRINTING APPARATUS

(71) Applicant: DAINIPPON SCREEN MFG. CO., LTD., Kyoto (JP)

(72) Inventors: Katsuyuki Hisaoka, Kyoto (JP); Kazuki Fukui, Kyoto (JP)

(73) Assignees: SCREEN Holdings Co., Ltd., Kyoto (JP); Ricoh Company, Ltd., Tokyo (JP)

( * ) Notice: Subject to any disclaimer, the term of this patent is extended or adjusted under 35 U.S.C. 154(b) by 63 days.

(21) Appl. No.: 13/781,614

(22) Filed: Feb. 28, 2013

(65) Prior Publication Data

US 2013/0222459 A1 Aug. 29, 2013

(30) Foreign Application Priority Data

Feb. 28, 2012 (JP) ..... 2012-041258

(51) Int. Cl.
*B41J 29/38* (2006.01)
*B41J 13/26* (2006.01)
*B41J 11/00* (2006.01)

(52) U.S. Cl.
CPC ..... *B41J 13/26* (2013.01); *B41J 11/0095* (2013.01)

(58) Field of Classification Search
CPC ..... B41J 11/42; B41J 29/393; B41J 29/38; B41J 3/60; B41J 11/0095
USPC ..... 347/16
See application file for complete search history.

(56) References Cited

U.S. PATENT DOCUMENTS 6,340,984 B1 * 1/2002 Ui et al. ..... 347/139
2002/0054347 A1 5/2002 Ikeda (Continued)

FOREIGN PATENT DOCUMENTS

JP 2002-94764 A 3/2002
JP 2008-105347 * 5/2008 ..... B41J 2/01

(Continued)

OTHER PUBLICATIONS

Extended European Search Reported issued in Application No. 13155781.1 dated Jul. 1, 2013.
European Office Action issued in European Application No. 13155781.1-1701 dated Dec. 15, 2014.

*Primary Examiner* — Manish S Shah
*Assistant Examiner* — Yaovi Ameh
(74) *Attorney, Agent, or Firm* — McDermott Will & Emery LLP

(57) ABSTRACT

Provided is a data processing method of a printing apparatus for printing a multi-color image on a printing medium by each of printing heads for at least two colors while transporting the printing medium relative to the printing heads in a paper-feed direction. The method includes a skew detecting step of detecting a degree of skew of the printing medium; a correction printing-data generating step of shifting print data from a printing unit for performing printing in a direction orthogonal to the paper-feed direction in accordance with the degree of skew to generate correction printing-data, the printing unit having a first printing head disposed upstream in the paper-feed direction and a second printing head spaced away from the first printing head downstream in the paper-feed direction; and a printing step of performing printing on the printing medium with the printing unit in accordance with the correction printing-data.

14 Claims, 5 Drawing Sheets

(56) References Cited

U.S. PATENT DOCUMENTS

2009/0323131 A1 12/2009 Toyoda
2012/0061909 A1* 3/2012 Shikama et al. ..... 271/227

FOREIGN PATENT DOCUMENTS

JP 2008-105347 A 5/2008
JP 2010-167723 A 8/2010

* cited by examiner

DATA PROCESSING METHOD OF PRINTING APPARATUS AND THE PRINTING APPARATUS

RELATED APPLICATIONS

This application claims the benefit of priority of Japanese Application No. 2012-041258, filed on Feb. 28, 2012, the disclosure of which Application is incorporated by reference herein.

BACKGROUND OF THE INVENTION

1. Field of the Invention

This invention relates to a data processing method of a printing apparatus and the printing apparatus for printing a multicolor image on a printing medium, such as a printing paper or a film, while transporting the printing medium relative to printing heads for at least two colors. More particularly, this invention is directed to a data processing technique in a printing apparatus having printing heads being spaced away for each color in a medium-feed direction.

2. Description of the Related Art

In performing printing with use of an inkjet printing apparatus, a first method of this type conventionally includes the following. That is, the method includes transporting a printing paper, detecting a transportation speed of the printing paper, detecting a skew angle of the printing paper, correcting the transportation speed in accordance with the transportation speed and the skew angle, and controlling a discharge timing of ink droplets from two or more printing heads in accordance with the corrected transportation speed. See, for example, Japanese Patent Publication No. 2008-105347.

Moreover, printing is performed with use of an inkjet printing apparatus with a printing head that has two or more inkjet heads with ink discharging nozzles being formed in a staggered arrangement in a direction of ink droplets orthogonal with respect to a transporting direction of a printing paper while moving the printing head and a printing paper relative to each other. In this printing, a second method of this type includes, when skew occurs, discharging ink droplets in accordance with a skew angle from some of the ink discharging nozzles that are disposed adjacent to an end in the direction orthogonal with respect to the transporting direction and in the same position seen from the transporting direction, and stopping discharge of the ink droplets from some of the ink discharging nozzles. Consequently, the ink discharging nozzles in the direction orthogonal with respect to the transport direction are selectively used. See, for example, Japanese Patent Publication No. 2010-167723.

In the second method, two or more ink discharging nozzles arranged orthogonally with respect to the transport direction are switched selectively in accordance with skew of the printing paper. Consequently, variation in pitch of an edge between the inkjet heads of the printing head (a connecting portion of the inkjet heads) can be eliminated.

However, the conventional examples with such constructions have the following problems.

Specifically, the conventional first method enables to prevent deviation of ink droplets in the transport direction. On the other hand, the method cannot prevent deviations of ink droplets in the direction orthogonal with respect to the transport direction. Such problem may arise. Moreover, the conventional second method enables to prevent deviation of ink droplets within the same printing head in the direction orthogonal with respect to the transport direction. On the other hand, the method cannot prevent deviation among two or more printing heads in the direction orthogonal with respect to the transport direction. Consequently, the first and second methods cannot prevent dot deviation due to skew in the direction orthogonal with respect to the transport direction, resulting in degradation in quality of the printing image. Such problem may also arise. Moreover, ink droplets in different colors are discharged in two or more printing heads. Thus, dot deviation is very remarkable even when the deviation is slightly generated. As a result, degradation in image quality due to the dot deviation is regarded as printing failure. Accordingly, the dot deviation among the printing heads leads to a remarkable problem.

SUMMARY OF THE INVENTION

Additional features of the invention will be set forth in the description which follows, and in part will be apparent from the description, or may be learned by practice of the invention.

This invention has been made regarding the state of the art noted above, and its object is to provide a data processing method of a printing apparatus and the printing apparatus that eliminates dot deviation among printing heads in a direction orthogonal with respect to a medium-feed direction even when a printing medium is skewed.

The above object is fulfilled, according to this invention, by a data processing method of a printing apparatus for printing a multi-color image on a printing medium by each of printing heads for at least two colors while transporting the printing medium relative to the printing heads in a paper-feed direction. The method includes a skew detecting step of detecting a degree of skew of the printing medium; a correction printing-data generating step of shifting print data from a printing unit for performing printing in a direction orthogonal with respect to the paper-feed direction in accordance with the degree of skew to generate correction printing-data, the printing unit having a first printing head disposed at an upstream end in the paper-feed direction and a second printing head spaced away from the first printing head in a downstream end in the paper-feed direction; and a printing step of performing printing on the printing medium with the printing unit in accordance with the correction printing-data.

The method according to one aspect of this invention includes the correction printing-data generating step. In this step, the print data for performing printing from the printing unit having the first and second printing heads is shifted in the direction orthogonal with respect to the paper-feed direction in accordance with the degree of skew of the printing medium detected in the skew detecting step. Consequently, correction printing-data is generated. In the printing step, printing is performed on the printing medium with the printing unit in accordance with the correction printing-data. The correction printing-data is generated by shifting the print data in the direction orthogonal with respect to the paper-feed direction in accordance with the degree of skew of the printing medium, resulting in prevention of dot deviation between the printing heads in the direction orthogonal to the paper-feed direction.

Moreover, it is preferable that the correction printing-data generating step in one aspect of this invention includes shifting the print data in a skewed direction of the printing medium in accordance with the degree of skew of the printing medium.

Deviation in the direction orthogonal with respect to the paper-feed direction increases as the degree of skew of the printing medium increases. Consequently, shifting the print data in the skewed direction of the printing medium in accordance with the degree of skew of the printing medium allows prevention of dot deviation appropriately.

Moreover, in the correction printing-data generating step in the method according to one aspect of this invention, the correction printing-data is preferably generated as follows. That is, when the printing medium is not skewed, a printing section of the printing head is replaced with another printing section. Another printing section above is selected from the other printing sections disposed in the direction orthogonal with respect to the paper-feed direction from the printing section and disposed in a direction where the printing medium is skewed, or is selected from the other printing sections disposed in the direction orthogonal with respect to the paper-feed direction from the printing section, disposed in the direction where the printing medium is skewed, and disposed on a side of an intersection of a reference line corresponding to a transport line when the printing medium is not skewed and a skewed line corresponding to a transport line when the printing medium is skewed.

The printing section of the printing head is replaced with another printing section that is selected from the other printing sections disposed in the direction orthogonal with respect to the paper-feed direction from the printing section and disposed in the direction where the printing medium is skewed. Consequently, dot deviation in the direction orthogonal with respect to the paper-feed direction can be prevented. Where the printing medium has a high degree of skew, deviation in the paper-feed direction should not be disregarded. Then the printing section is replaced with another printing section disposed in the direction where the printing medium is skewed and disposed on the side of the intersection of the reference line corresponding to the transport line when the printing medium is not skewed and the skewed line corresponding to the transport line when the printing medium is skewed. Accordingly, deviation in the paper-feed direction can be prevented. Consequently, printing quality can be enhanced even when the printing medium is largely skewed.

Another aspect of this invention discloses a printing apparatus for printing a multi-color image on a printing medium by each of printing heads for at least two colors while transporting the printing medium relative to the printing heads in a paper-feed direction. The apparatus includes a transport section for transporting the printing medium relative to the printing heads for at least two colors; a printing unit having a first printing head disposed at an upstream end in the paper-feed direction and a second printing head spaced away from the first printing head in a downstream end in the paper-feed direction, the printing unit enabling at least two-color printing; a skew detecting section for detecting a degree of skew of the printing medium in the transport section; and a printing-data generating section for shifting print data from the printing unit for performing printing in the direction orthogonal with respect to the paper-feed direction in accordance with the degree of skew to generate correction printing-data and output the correction printing-data into the printing unit.

In the apparatus according another aspect of this invention, the skew detecting section detects the degree of skew of the printing medium transported relative to the printing unit by the transport section. The printing-data generating section shifts the print data from the printing unit for performing printing in the direction orthogonal with respect to the paper-feed direction in accordance with the degree of skew to generate correction printing-data and output the correction printing-data into the printing unit. The correction printing-data generated by the printing-data generated section is obtained by shifting the print data in the direction orthogonal with respect to the paper-feed direction in accordance with the degree of skew of the printing medium. As a result, dot deviation between the printing heads in the direction orthogonal to the paper-feed direction can be prevented when the printing medium is skewed.

Moreover, it is preferable that the printing-data generating section in the apparatus according to another aspect of this invention shifts the print data in a skewed direction of the printing medium in accordance with the degree of skew of the printing medium.

Deviation in the direction orthogonal with respect to the paper-feed direction increases as the degree of skew of the printing medium increases. Consequently, shifting the print data in the skewed direction of the printing medium in accordance with the degree of skew of the printing medium allows suitable prevention of dot deviation.

Moreover, it is preferable that the printing-data generating section in the apparatus according to another aspect of this invention generates the correction printing-data as follows. That is, when the printing medium is not skewed, a printing section of the printing head is replaced with another printing section. Another printing section above is selected from the other printing sections disposed in the direction orthogonal with respect to the paper-feed direction from the printing section and disposed in a direction where the printing medium is skewed, or is selected from the other printing sections placed in the direction orthogonal with respect to the paper-feed direction from the printing section, disposed in the direction where the printing medium is skewed, and disposed on a side of an intersection of a reference line corresponding to a transport line when the printing medium is not skewed and a skewed line corresponding to a transport line when the printing medium is skewed.

The printing section of the printing head is replaced with another printing section that is selected from the other printing sections disposed in the direction orthogonal with respect to the paper-feed direction from the printing section and disposed in the direction where the printing medium is skewed. Consequently, dot deviation in the direction orthogonal with respect to the paper-feed direction can be prevented. Where the printing medium has a high degree of skew, deviation in the paper-feed direction should not be disregarded. Then the printing section is replaced with another printing section disposed on the side of the intersection of the reference line corresponding to the transport line when the printing medium is not skewed and the skewed line corresponding to the transport line when the printing medium is skewed. Accordingly, deviation in the paper-feed direction can also be prevented. Consequently, printing quality can be enhanced even when the printing medium is largely skewed.

It is to be understood that both the foregoing general description and the following detailed description are exemplary and explanatory and are intended to provide further explanation of the invention as claimed.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

(a) illustrating correction print data of a first printing head, (b) illustrating correction print data of a second printing head, (c) illustrating a condition where the correction print data is superimposed while the web paper is not skewed, and (d) illustrating a condition where the correction print data is superimposed while the web paper is skewed.

Figure 3:
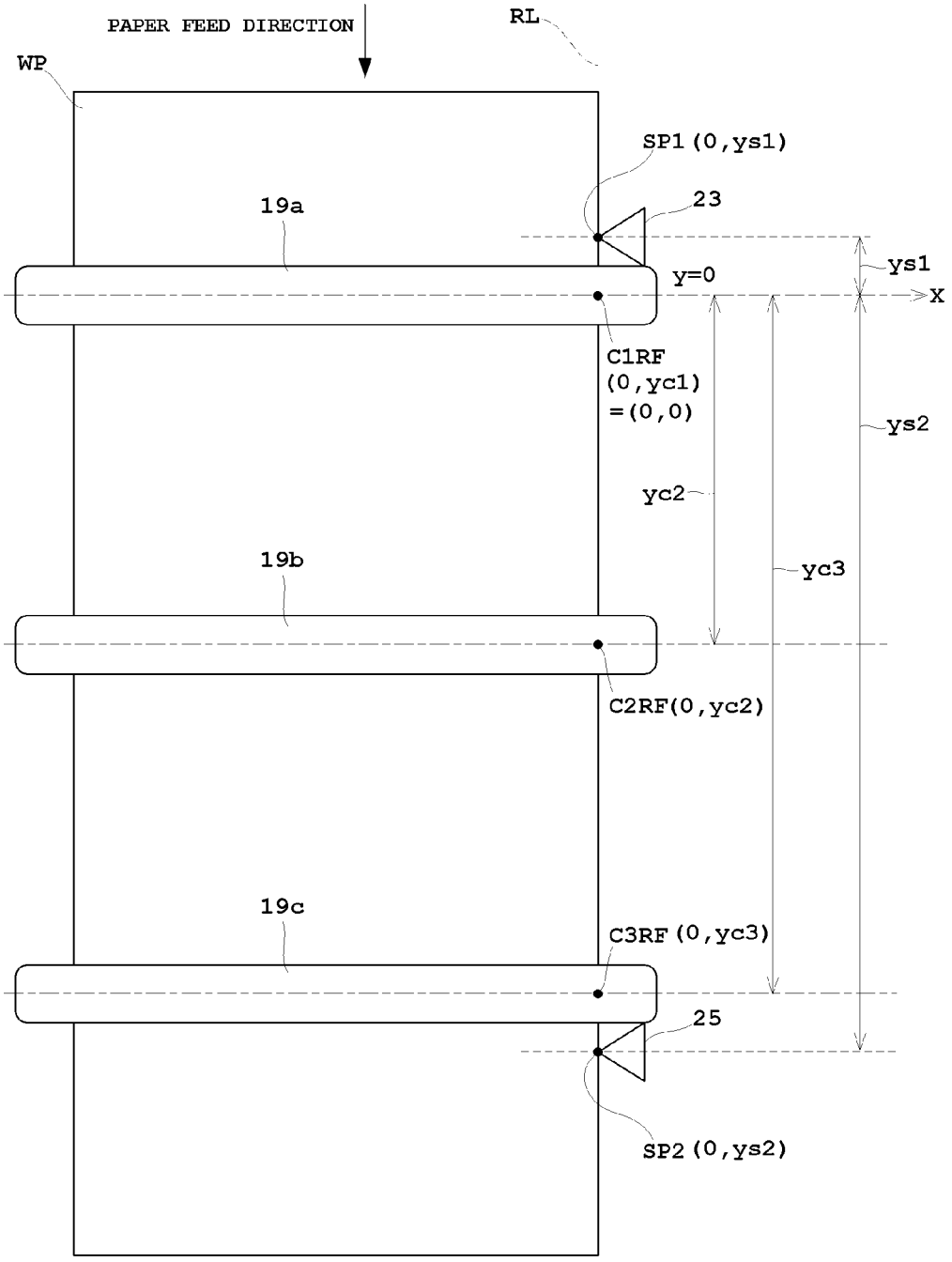

FIG. 3 is a schematic plan view of a positional relationship between each of the printing heads and sensors.

Figure 4:
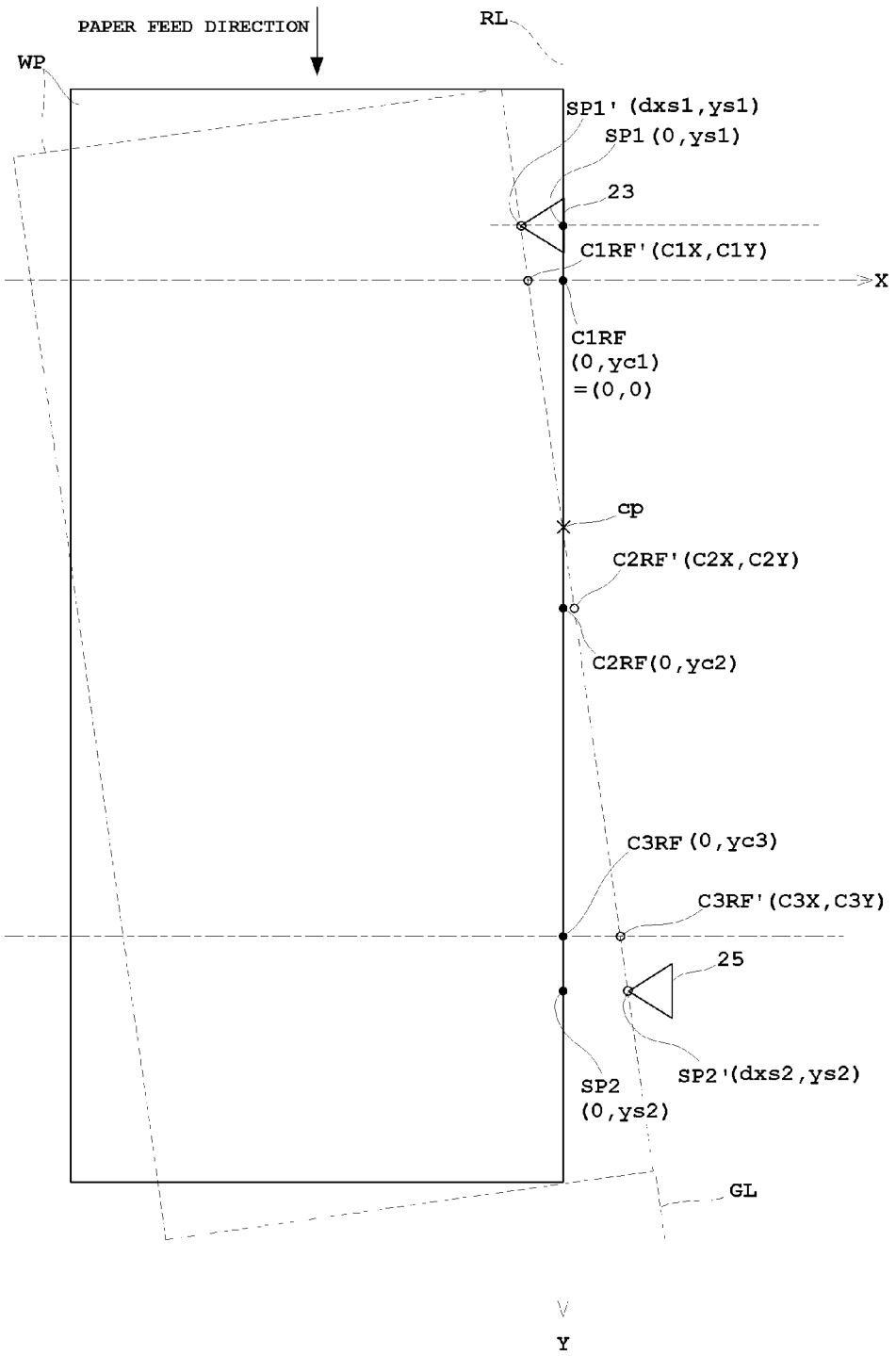

FIG. 4 is a schematic plan view of the positional relationship while the web paper is skewed.

Figure 5:
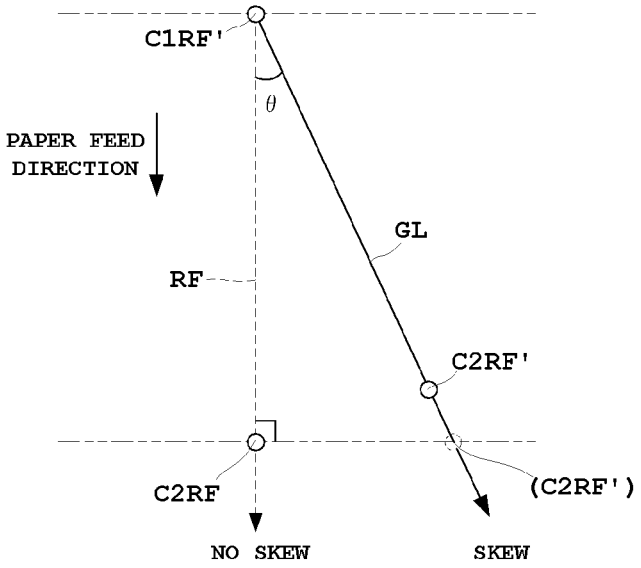

FIG. 5 is a schematic view illustrating dot deviating when the web paper is skewed.

Figure 6:
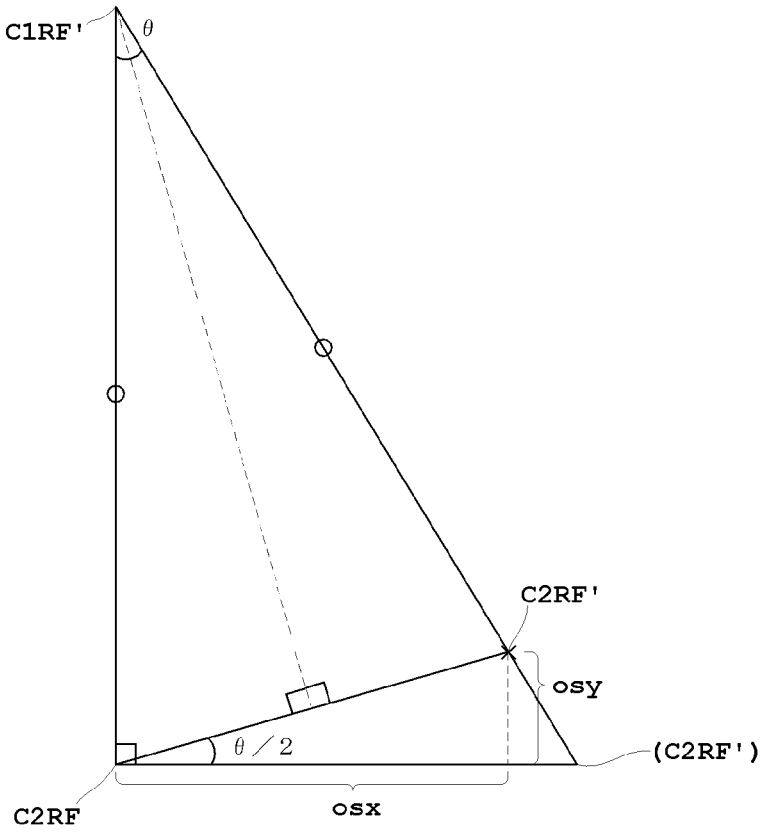

FIG. 6 is a schematic view illustrating a suitable position for applying droplets when the web paper is skewed.

DESCRIPTION OF THE PREFERRED EMBODIMENTS

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

Figure 1:
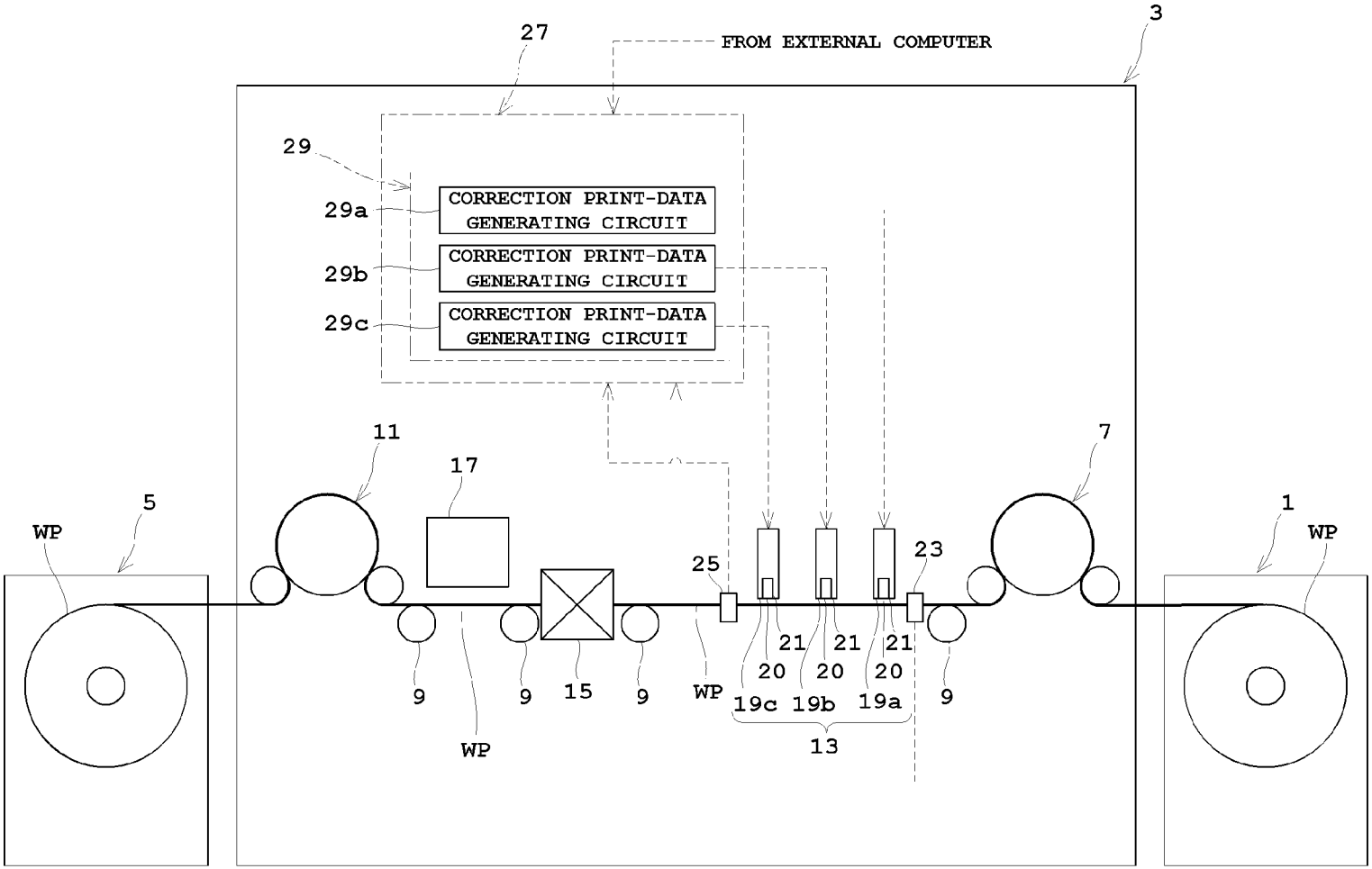
FIG. 1 is a schematic view showing an entire inkjet printing system according to one embodiment of this invention.

One embodiment of this invention will be described hereinafter with reference to the drawings. In the following embodiments, description will be given of a web paper for a printing paper as one example of a printing medium. FIG. 1 is a schematic view illustrating an entire inkjet printing system according to one embodiment of this invention.

An inkjet printing system according to one embodiment of this invention includes a paper feeder 1, an inkjet printing apparatus 3, and a take-up roller 5.

The paper feeder 1 holds the web paper WP in the roll form to be rotatable about a horizontal axis, and unwinds the web paper WP to feed it to the inkjet printing apparatus 3. The take-up roller 5 winds up the web paper WP printed by the inkjet printing apparatus 3 about a horizontal axis. Regarding the side from which the web paper WP is fed as upstream and the side to which the web paper WP is taken up as downstream, the paper feeder 1 is disposed upstream of the inkjet printing apparatus 3 while the take-up roller 5 is disposed downstream of the inkjet printing apparatus 3.

The inkjet printing apparatus 3 includes a drive roller 7 in an upstream position thereof for taking in the web paper WP from the paper feeder 1. The web paper WP unwound from the paper feeder 1 by the drive roller 7 is transported downstream toward the take-up roller 5 along two or more transport rollers 9. A drive roller 11 is disposed between the most downstream transport roller 9 and the take-up roller 5. The drive roller 11 feeds the web paper WP travelling on the transport rollers 9 toward the take-up roller 5.

The inkjet printing apparatus 3 above corresponds to the "printing apparatus" in this invention. The drive rollers 7, 11 and the transport rollers 9 correspond to the "transport section" in this invention.

Between the drive roller 7 and drive roller 11, the inkjet printing apparatus 3 has a printing unit 13, a drying unit 15, and an inspecting unit 17 arranged in this order from upstream to downstream. The drying unit 15 dries portions printed by the printing unit 13. The inspecting unit 17 inspects the printed portions for any stains or omissions.

The printing unit 13 has printing heads 19 for discharging ink droplets. The printing unit 13 includes two or more printing heads being arranged in the transport direction of the web paper WP. For instance, this embodiment includes three printing heads 19. Here, each printing head 19 is formed by a first printing head 19*a*, a second printing head 19*b*, and a third printing head 19*c* in this order from upstream toward downstream. The printing heads 19 are spaced away by a given distance in the transport direction. The first printing head 19*a*, the second printing head 19*b*, and the third printing head 19*c* each have a nozzle 21 with two or more inkjet nozzles 20 for discharging ink droplets. The printing heads 19*a* to 19*c* discharge ink droplets in at least two colors, and allows multicolor printing on the web paper WP. For instance, the first printing head 19*a* is for cyanogen (C), the second printing head 19*b* is for magenta (M), and the third printing head 19*c* is for yellow (Y). The nozzles 21 each have two or more inkjet nozzles 20 arranged in the transport direction of the web paper WP (in a horizontal direction on the plane of FIG. 1) and two or more inkjet nozzles 20 also arranged in a direction orthogonal with respect to the transport direction of the web paper WP (in the depth direction on the plane of FIG. 1).

The two or more inkjet nozzles 20 mentioned above correspond to the "printing section" in this invention.

The printing unit 13 has a first sensor 23 arranged at an upstream end thereof, and a second sensor 25 arranged at a downstream end thereof. The first and the second sensors 23 and 25 are arranged at ends of a transport path of the web paper WP, respectively, to detect positions of side edges of the web paper WP. The first and the second sensors 23 and 25 detect skew of the side edges of the web paper WP and a degree of skew of the web paper WP relative to a "reference line". The reference line corresponds to a transport line of the web paper WP when the web paper WP is normally transported.

The first and second sensors 23 and 25 mentioned above correspond to the "skew detecting section" in this invention.

The inkjet printing apparatus 3 includes a controller 27. The controller 27 includes a CPU and a memory. The controller 27 also includes a data processing section 29. The controller 27 receives print data as data on images printed on the web paper WP from an external computer, and transports the web paper WP in accordance with the print data. The data processing section 29 determines the degree of skew of the web paper WP in accordance with signals from the first and second sensors 23 and 25 (a skew detecting step), and corrects the print data in accordance with the degree of skew to generate correction print data (a correction print-data generating step). Thereafter, the data processing section 29 outputs the correction print data to each printing head 19 (19*a* to 19*c*) to perform printing on the web paper WP (a printing step).

The data processing section 29 includes correction print-data generating circuits 29*a*, 29*b*, and 29*c* for the first, second and third printing heads 19*a*, and 19*b*, 19*c*, respectively. When it is detected that the web paper WP is skewed in accordance with output from the first and second sensors 23 and 25, the data processing section 29 corrects the print data from the external computer into the correction print data. When it is detected that the web paper WP is not skewed, the print data from the external computer is outputted as it is into the printing unit 13.

Here, the data processing unit 29 mentioned above corresponds to the "print-data generating section" in this invention.

Figures 2A, 2B, 2C, 2D:
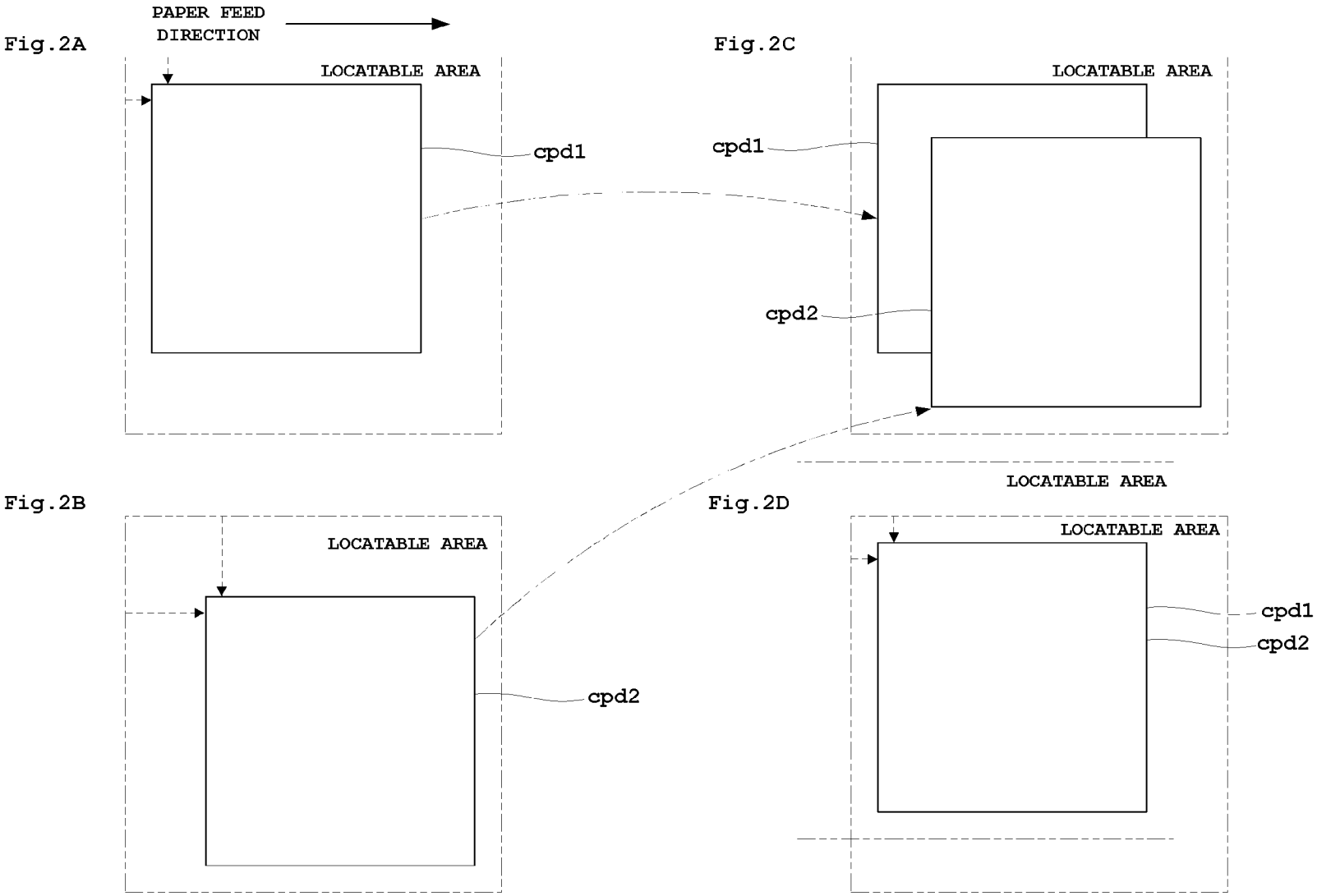
FIG. 2 is a schematic view for illustrating an outline of correction print data generated when a web paper is skewed.

Reference is now made to FIG. 2. FIG. 2 is a schematic view for illustrating an outline of correction print data generated while the web paper is skewed. FIG. 2(*a*) illustrates correction print data of the first printing head. FIG. 2(*b*)

illustrates correction print data of the second printing head. FIG. 2(*c*) illustrates a condition where the correction print data is superimposed while the web paper is not skewed. FIG. 2(*d*) illustrates a condition where the correction print data is superimposed while the web paper is skewed. In order to facilitate understanding of the invention, the following description will be given taking for example the first and second printing heads 19*a* and 19*b* only.

The data processing section 29 sets a locatable area for locating the print data. The locatable area is larger than that when no skew occurs. That is because, when skew occurs, printing has to be performed beyond the locatable area that is obtained when no skew occurs. The correction print-data generating circuit 29*a* generates the correction print data in accordance with the degree of skew obtained through the output from the first and second sensors 23 and 25 such that the inkjet nozzle 20 from which ink droplets are to be discharged when no skew occurs is replaced with the inkjet nozzle 20 selected from the other nozzles 20 disposed in the direction orthogonal with respect to the paper-feed direction and spaced away by a distance in accordance with the degree of skew. In other words, the correction print-data generating circuit 29*a* generates the correction print data such that ink droplets are discharged from the inkjet nozzle 20 spaced away. In the following description, the direction in which the side edge of the web paper 5 is moved under the non-skewed state is called the paper-feed direction, which differs from the direction in which the side edge of the web paper 5 is moved under the skewed state.

When the web paper has a high degree of skew, the nozzle 20 is substituted to perform printing in accordance with a positional relationship relative to the intersection of the reference line of the web paper WP when no skew occurs and a "skewed line" corresponding to the transport line when the printing medium is skewed. Here, the nozzle 20 is spaced away in the direction orthogonal with respect to the paper-feed direction toward the intersection. Specifically, the correction print data is generated such that ink droplets are discharged from the inkjet nozzle 20, instead of the inkjet nozzle 20 from which ink droplets are to be discharged when no skew occurs, that is selected from the other nozzles 20 disposed in the direction orthogonal with respect to the paper-feed direction on the skewed side and spaced away by a distance in accordance with the degree of skew.

Here, it is assumed that correction print data cpd1 of the first printing head 19*a* is shifted from a corner in the locatable area in the paper-feed direction and a direction orthogonal thereto in accordance with the degree of skew, as illustrated in FIG. 2(*a*). Moreover, it is assumed that correction print data cpd2 of the second printing head 19*b* is shifted more largely rather than the first printing head 19*a* from the corner in the locatable area in the paper-feed direction and the direction orthogonal thereto in accordance with the degree of skew, as illustrated in FIG. 2(*b*). Then the correction print-data cpd1 and cpd2 is superimposed such that the locatable areas overlap to obtain the condition as illustrated in FIG. 2(*c*). That is, an image is generated containing dot deviation in accordance with the degree of skew. On the other hand, the locatable areas are arranged regarding the degree of skew to obtain the condition as illustrated in FIG. 2(*d*). That is, the correction print-data cpd1 and cpd2 forms an image at the same position, resulting in elimination of adverse influences of dot deviation due to skew.

Next, description will be given of determining the inkjet nozzle 20 to be replaced in generating the correction print data with reference to FIGS. 3 and 4. FIG. 3 is a schematic plan view of a positional relationship between each of the printing heads and sensors. FIG. 4 is a schematic plan view of the positional relationship while the web paper is skewed.

When the web paper WP is not skewed as illustrated in FIG. 3, the first printing head 19*a*, the second printing head 19*b*, and the third printing head 19*c* intersect the side edges of the web paper WP at right angles. Under this state, let a line corresponding to a transport line of a right side edge of the web paper WP be a reference line RL. Here, the reference line RL conforms to a Y-axis. Also let the direction of the first printing head 19*a* orthogonal with respect to the paper-feed direction be an X-axis. Here, a reference position of the first printing head 19*a* of the inkjet nozzle 20 on the reference line RL under the non-skewed state is denoted by C1RF, and a coordinate thereof is denoted by (0, yc1)=(0, 0). Moreover, a reference position of the second printing head 19*b* of the inkjet nozzle 20 on the reference line RL is denoted by C2RF, and a coordinate thereof is denoted by (0, yc2). A reference position of the third printing head 19*c* of the inkjet nozzle 20 on the reference line RL is denoted by C3RF, and a coordinate thereof is denoted by (0, yc3). Furthermore, a reference detection position of the first sensor 23 is denoted by SP1 and a coordinate thereof is denoted by (0, ys1). A reference detection position of the second sensor 25 is denoted by SP2, and a coordinate thereof is denoted by (0, ys2).

When the web paper WP is skewed as illustrated in FIG. 4, a detection position of the first sensor is denoted by SP1', and a coordinate thereof is denoted by (dxs1, ys1). Moreover, a detection position of the second sensor is denoted by SP2', and a coordinate thereof is denoted by (dxs2, ys2). Letting a transport line of the side edge of the skewed web paper WP be a skewed line GL, an intersection of the skewed line GL and the reference line RL (the Y-axis) of the web paper WP is denoted by cp. Moreover, let a suitable position of the inkjet nozzle 20 having the first printing head 19*a* discharging ink droplets while the web paper WP is skewed be denoted by C1RF', and a coordinate thereof be denoted by (C1X, C1Y). Let a suitable position of the inkjet nozzle 20 having the second printing head 19*b* discharging ink droplets be denoted by C2RF', and a coordinate thereof be denoted by (C2X, C2Y). Let a suitable position of the inkjet nozzle 20 having the third printing head 19*c* discharging ink droplets be denoted by C3RF', and a coordinate thereof be denoted by (C3X, C3Y).

Where the web paper WP has a lower degree of skew, the data processing section 29 generates correction print data such that the nozzle 20 having the first printing head 19*a* is replaced with the nozzle 20 that is selected from the other nozzles 20 disposed in the direction orthogonal with respect to the paper-feed direction and in the position C1RF'. Then the data processing section 29 outputs the correction print data into the printing head 19. Similarly, the nozzle 20 having the second printing head 19*b* is replaced with the nozzle in the position C2RF'. The nozzle 20 having the third printing head 19*c* is replaced with the nozzle in the position C3RF'. Here, the position C1RF' and others can be determined from coordinates of the first and second sensors 23 and 25 when the web paper is skewed and coordinates of the printing heads 19*a* to 19*c*.

Where the web paper WP has a higher degree of skew, substitution of another inkjet nozzle 20 mentioned above in the direction orthogonal with respect to the paper-feed direction cannot eliminate dot deviation completely. Accordingly, an offset value (difference between the coordinates) is determined as follows, and another nozzle 20 disposed on a coordinate shifted by the offset value is substituted. Consequently, dot deviation can be eliminated with the higher degree of skew.

Reference is made next of FIGS. 5 and 6. FIG. 5 is a schematic view illustrating dot deviating when the web paper is skewed. FIG. 6 is a schematic view illustrating a suitable position for applying droplets when the web paper is skewed.

In order to facilitate understanding of the invention, a position of ink droplets applied from the first printing head 19*a* of the inkjet nozzle 20 is denoted by C1RF' in FIG. 5. Moreover, a position of ink droplets to be applied from the second printing head 19*b* of the inkjet head 20 is denoted by C2RF when no skew occurs (illustrated by dotted lines in FIG. 5). When skew occurs, a position of ink droplets to be applied has to be shifted toward the skewed line illustrated by solid lines. At this time, dot deviation occurs in the paper-feed direction at a position (C2RF') corresponding to the position shifted from the position C2RF in the direction orthogonal with respect to the paper-feed direction (illustrated by long dashed double-short dashed lines on FIG. 5). Consequently, the position C2RF' located on an intersection cp side should be determined for eliminating dot deviation in the paper-feed direction. As illustrated in FIG. 6, the position C2RF' is located away from the position C2RF under the non-skewed state by a distance osx in the X-axis direction and a distance osy in the Y-axis direction.

Specifically, a shift amount of the first printing head 19*a* may be given by Equations (1) and (2) below. Moreover, a shift amount of the second printing head 19*b* may be given by Equations (3) and (4) below, and that of the third printing head 19*c* by Equations (5) and (6) below. In the following equations, a gradient A=(ys2−ys1)/(dxs2−dxs1), and an intercept B=ys1−A·dxs1. In addition, $\theta=\tan^{-1}(1/A)$.

The first printing head 19*a:*

$$C1X=B\cdot 2\sin(\theta/2)\cdot\cos(\theta/2) \quad (1)$$

$$C1Y=B\cdot 2\sin(\theta/2)\cdot\sin(\theta/2) \quad (2)$$

The second printing head 19*b:*

$$C2X=(B+yc2)\cdot 2\sin(\theta/2)\cdot\cos(\theta/2) \quad (3)$$

$$C2Y=(B+yc2)\cdot 2\sin(\theta/2)\cdot\sin(\theta/2)-yc2 \quad (4)$$

The third printing head 19*c:*

$$C3X=(B+yc3)\cdot 2\sin(\theta/2)\cdot\cos(\theta/2) \quad (5)$$

$$C3Y=(B+yc3)\cdot 2\sin(\theta/2)\cdot\sin(\theta/2)-yc3 \quad (6)$$

In the embodiment mentioned above, the first and second sensors 23 and 25 detect the degree of skew of the web paper WP transported relative to the printing unit 19 with the drive rollers 7 and 11 and the transport rollers 9. The data processing section 29 shifts the print data from the printing unit 19 for performing printing into the direction orthogonal with respect to the paper-feed direction in accordance with the degree of skew of the web paper WP, and generates the data as the correction print data to output the correction print data into the printing unit 19. The correction printing data generated by the printing-data generated section 29 is obtained by shifting the print data in the direction orthogonal with respect to the paper-feed direction in accordance with the degree of skew of the web paper WP. As a result, dot deviation between the printing heads 19*a* to 19*c* in the direction orthogonal to the paper-feed direction can be prevented although the web paper WP is skewed.

This invention is not limited to the foregoing embodiments, but may be modified as follows:

(1) The foregoing embodiments have been described taking for example the inkjet printing apparatus that performs printing on the web paper WP in a roll form. However, this invention is not limited to such web paper WP, but is applicable also to an inkjet printing apparatus for printing on various types of printing medium such as a film.

(2) The foregoing embodiments have been described taking for example the inkjet-type printing apparatus as the printing apparatus. This invention is applicable to a printing apparatus having no lithographic plate in which printing heads are spaced away in a paper-feed direction.

(3) In the embodiments mentioned above, only when the web paper has a high degree of skew, another inkjet nozzle 20 is substituted that is disposed on an intersection side from the direction orthogonal with respect to the paper-feed direction. Alternatively, such configuration may be adopted when the web paper has a low degree of skew.

(4) In the embodiments mentioned above, the correction print data is generated in accordance with the degree of skew of the web paper in the paper-feed direction. Alternatively, errors occurring upon attaching each printing head in the longitudinal direction may be adjusted by generating the correction print data by which the image has been shifted in the X-axis direction.

(5) In the embodiments mentioned above, the correction print data is generated in accordance with the degree of skew of the web paper in the paper-feed direction. Alternatively, when pitches for attaching each of the printing heads are not sufficiently adjusted, the pitches may be adjusted by generating the correction print data by which the image has been shifted in the Y-axis (transport) direction.

This invention may be embodied in other specific forms without departing from the spirit or essential attributes thereof and, accordingly, reference should be made to the appended claims, rather than to the foregoing specification, as indicating the scope of the invention.

What is claimed is:

1. A data processing method of a printing apparatus for printing a multi-color image on a printing medium by a first printing head and a second printing head while transporting the printing medium relative to the first printing head and the second printing head in a printing medium-feed direction, the first printing head being disposed upstream of the printing medium-feed direction and the second printing head being spaced away from the first printing head and being disposed downstream of the paper-feed direction, the method comprising:

a skew detecting step of detecting a degree of skew of the printing medium;

a correction printing-data generating step of shifting print data for performing multi-color image printing for every printing color in a locatable area in a direction orthogonal with respect to the medium-feed direction in accordance with the degree of skew to generate correction printing-data, the locatable area being set for locating the print data for the every printing color; and a printing step of performing printing on the printing medium with the first printing head and the second printing head in accordance with the correction printing-data, wherein in the correction printing-data generating step, the locatable area being set wider than a locatable area with no skew, and a shift amount of the first printing head being larger than a shift amount of the second printing head in the printing medium-feed direction and the direction orthogonal with respect to the printing medium-feed direction.

2. The data processing method of the printing apparatus according to claim 1, wherein in the correction printing-data generating step, the correction printing data printed by the second printing head is shifted more largely than the correction printing data printed by the first printing head in a skewed direction of the printing medium in accordance with the degree of skew of the printing medium.

3. The data processing method of the printing apparatus according to claim 2, wherein in the correction printing-data generating step, the correction printing data printed by the second printing head is shifted more largely than the correction printing data printed by the first printing head in the medium-feed direction in accordance with the degree of skew of the printing medium.

4. The data processing method of the printing apparatus according to claim 3, wherein in the correction printing-data generating step, the correction printing data printed by the second printing head is shifted more largely than the correction printing data printed by the first printing head in the medium-feed direction and the direction orthogonal with respect to the medium-feed direction by a distance in accordance with the degree of skew.

5. The data processing method of the printing apparatus according to claim 4, wherein the skew detecting step is performed by a first sensor and a second sensor sandwiching the first print head and the second print head for detecting positions of side ends of the printing medium.

6. The data processing method of the printing apparatus according to claim 1, wherein in the correction printing-data generating step, when the degree of skew is high, the locatable area corresponding to the correction printing data printed by the second printing head is shifted more largely than the locatable area corresponding to the correction printing data printed by the first printing head in the medium-feed direction and the direction orthogonal with respect to the medium-feed direction in consideration of the degree of skew.

7. The data processing method of the printing apparatus according to claim 1, wherein the printing medium includes a long printing medium.

8. A printing apparatus for printing a multi-color image on a printing medium, the apparatus comprising:

a printing unit having a first printing head disposed at an upstream end in a medium-feed direction and a second printing head spaced away from the first printing head in a downstream end in the medium-feed direction, the printing unit enabling at least two-color printing;

a transport section for transporting the printing medium relative to the printing heads in the medium-feed direction;

a skew detecting section for detecting a degree of skew of the printing medium in the transport section; and a correction printing-data generating section for shifting print data from the printing unit for performing multi-color image printing for every printing color in a locatable area in the direction orthogonal with respect to the medium-feed direction in accordance with the degree of skew to generate correction printing-data and output the correction printing-data into the printing unit, the locatable area being set for locating the print data for the every printing color, the locatable area being set wider than a locatable area with no skew, and a shift amount of the first printing head being larger than a shift amount of the second printing head in the printing medium-feed direction and the direction orthogonal with respect to the printing medium-feed direction.

9. The printing apparatus according to claim 8, wherein the correction print data generating section shifts the correction printing data printed by the second printing head more largely than the correction printing data printed by the first printing head in a skewed direction of the printing medium in accordance with the degree of skew of the printing medium.

10. The printing apparatus according to claim 9, wherein

The correction printing-data generating section shifts the correction printing data printed by the second printing head more largely than the correction printing data printed by the first printing head in the medium-feed direction in accordance with the degree of skew of the printing medium.

11. The printing apparatus according to claim 10, wherein

The correction printing-data generating section shifts the correction printing data printed by the second printing head more largely than the correction printing data printed by the first printing head in the medium-feed direction and the direction orthogonal with respect to the medium-feed direction by a distance in accordance with the degree of skew.

12. The printing apparatus according to claim 11, wherein the skew detecting section includes a first sensor and a second sensor sandwiching the first print head and the second print head for detecting positions of side ends of the printing medium.

13. The printing apparatus according to claim 8, wherein when the degree of skew is high, a correction printing-data generating section shifts the locatable area corresponding to the correction printing data printed by the second printing head more largely than the locatable area corresponding to the correction printing data printed by the first printing head in the medium-feed direction and the direction orthogonal with respect to the medium-feed direction in consideration of the degree of skew.

14. The printing apparatus according to claim 8, wherein the printing medium includes a long printing medium.

* * * * *